United States Patent [19]

Bond

[11] Patent Number: 4,601,410

[45] Date of Patent: Jul. 22, 1986

[54] COLLAPSED BAG WITH EVACUATION CHANNEL FORM UNIT

[75] Inventor: Curtis J. Bond, Worthington, Ohio

[73] Assignee: Liqui-Box Corporation, Worthington, Ohio

[21] Appl. No.: 681,746

[22] Filed: Dec. 14, 1984

Related U.S. Application Data

[63] Continuation-in-part of Ser. No. 594,761, Mar. 29, 1984.

[51] Int. Cl.[4] ..... B65D 35/00

[52] U.S. Cl. ..... 222/92; 222/105; 222/547; 493/213; 493/929; 383/33

[58] Field of Search ..... 222/92, 105, 386.5, 222/464, 83, 566, 547, 107; 383/33, 66, 80; 220/410, 85 B; 493/213, 929

[56] References Cited

U.S. PATENT DOCUMENTS

| | | | |
|---|---|---|---|
| 3,081,911 | 3/1963 | Scholle | 222/107 |
| 4,087,026 | 5/1978 | Petterson | 222/386.5 |
| 4,137,930 | 2/1979 | Scholle | 137/68 R |
| 4,138,036 | 2/1979 | Bond | 222/105 |
| 4,148,416 | 3/1979 | Gunn-Smith | 222/94 |
| 4,286,636 | 9/1981 | Credle | 141/114 |
| 4,445,550 | 5/1984 | Davis et al. | 141/329 |
| 4,524,458 | 6/1985 | Pongrass et al. | 383/33 |

FOREIGN PATENT DOCUMENTS

| | | | |
|---|---|---|---|
| 600684 | 6/1960 | Canada | 222/92 |
| WO83/01605 | 5/1983 | PCT Int'l Appl. . | |
| 1473524 | 5/1977 | United Kingdom . | |

*Primary Examiner*—Joseph J. Rolla
*Assistant Examiner*—Michael S. Huppert
*Attorney, Agent, or Firm*—William V. Miller; Sidney W. Millard

[57] ABSTRACT

A substantially flat collapsed plastic bag with an evacuation form unit insert positioned therein as manufactured to serve as a form about which the filled bag will collapse as it is emptied. The form unit comprises a ring for mounting the unit on the spout of the bag and a multichannel form extending radially from the ring and hingedly connected thereto. A simple method is provided for manufacturing the bag with the form unit insert.

27 Claims, 24 Drawing Figures

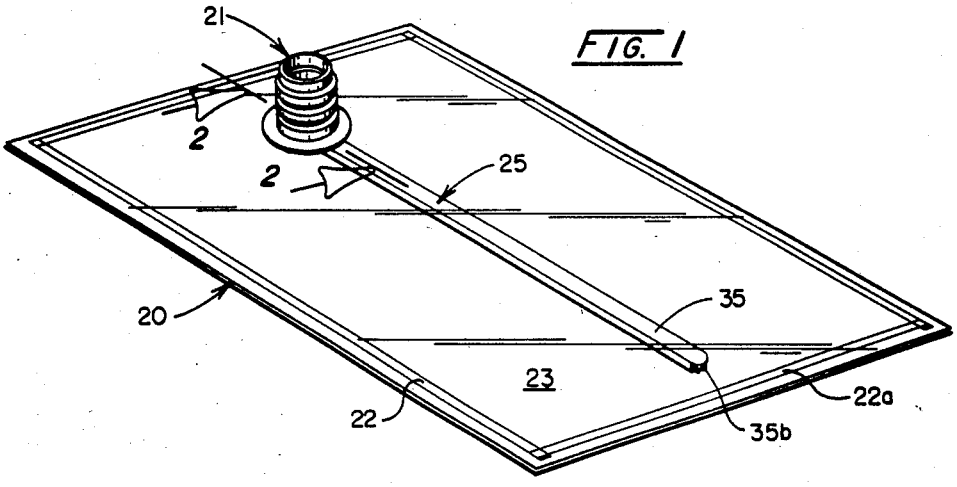
FIG. 1
FIG. 2
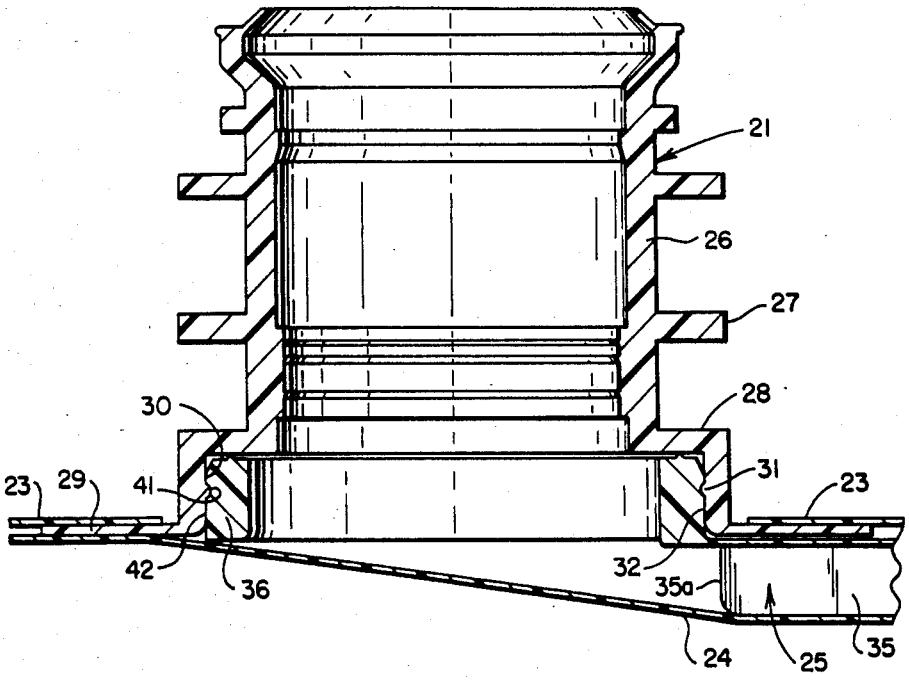

25b
37b
14A
14A
36b 25b
38b
36b
37b
34b
41b 25c
35c
36c
37c
16A
16A
50c
34c 50c
33c
36c
50c
34c 36b
33b
38b
37b
41b
34b

COLLAPSED BAG WITH EVACUATION CHANNEL FORM UNIT

This application is a continuation-in-part of application Ser. No. 594,761, filed Mar. 29, 1984.

BACKGROUND OF THE INVENTION AND PRIOR ART

This invention relates to a collapsed plastic bag with a form insert which is connected to the spout thereof so that it will extend into the filled bag and as its contents are withdrawn by a pressure differential on the bag, the bag will gradually collapse around the form to maintain an outlet passage to the spout until the bag is completely emptied.

A form of this general type is disclosed in U.S. Pat. No. 4,137,930 and merely consists of a perforated tube attached to the closure valve and about which the bag collapses. Another form of this general type is disclosed in U.S. Pat. No. 4,138,036 and consists of a flexible helical coil-adapter attached to the spout and about which the bag collapses to form a tubular passageway. Still another form of this general type is disclosed in U.S. Pat. No. 4,286,636 as consisting of a dip tube which is attached to the closure valve and which has longitudinal slots in the peripheral surface thereof leading into straight passages. With each of these forms, it is not possible to preinsert them into the bag before filling. It is necessary to first fill the bags and then the closure/-valve with the dip tube attachment must be carefully inserted after fill. Doing so at a reasonable rate, without making a mess and without excessive labor costs is impossible. Also, introduction of unwanted air into the bag will occur.

SUMMARY OF THE INVENTION

The passage-producing unit of this invention, about which the walls of the container or bag collapse as the bag is emptied, comprises an elongated open-face multi-channel form and an integral mounting ring hingedly attached to one end thereof and adapted to be used to mount the form on the bag spout. The evacuation form unit consisting of the opne-face channel and mounting ring is positioned flat within the bag and attached to the spout during the manufacture of the bag. The entire multi-channel form unit is preferably molded of plastic in one piece. A simple manufacturing method is provided the bag with the open channel form of the unit disposed flat between the opposed walls thereof and attached to the spout thereof.

BRIEF DESCRIPTION OF THE DRAWINGS

The best mode contemplated in carrying out this invention is illustrated in the accompanying drawings in which:

FIG. 1 is a perspective view of a flexible bag with the evacuation channel form unit of this invention disposed therein and attached to the spout thereof;

FIG. 2 is an enlarged sectional view taken along line 2—2 of FIG. 1;

DETAILED DESCRIPTION OF THE INVENTION

Figure 3:
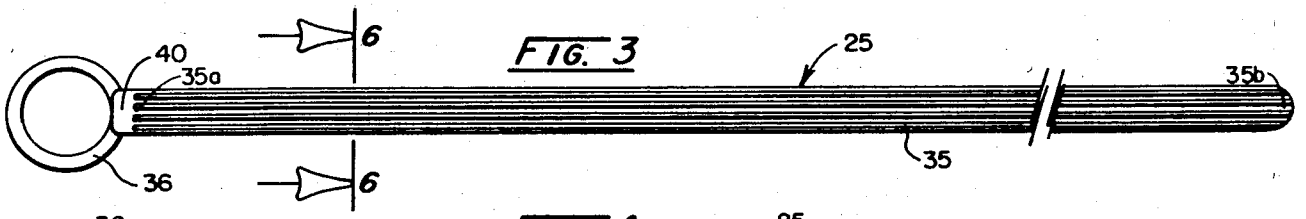
FIG. 3 is a plan view of the evacuation channel form and attaching ring of this invention.
Figure 4:
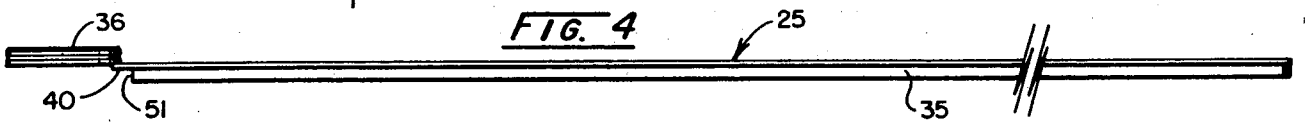
FIG. 4 is a side edge view of the unit of FIG. 1.
Figure 5:
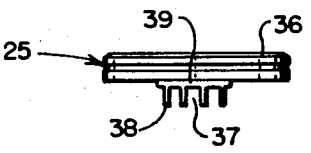
FIG. 5 is an end view of the ring end of the unit.
Figure 6:
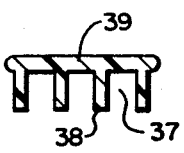
FIG. 6 is an enlarged transverse sectional view taken along line 6—6 of FIG. 3.

With specific reference to the drawings, there is illustrated in FIG. 1, a plastic bag 20 shown in its original manufactured, substantially flat collapsed form with a fitment in the form of a spout 21 extending from a side wall thereof near one end. The bag as manufactured is of flat rectangular form with a heat seal seam 22 along all its edges. The evacuation channel form unit 25 of this invention is inserted in the bag during manufacture and lies flat between the opposed superimposed flat walls 23 and 24 of the bag, as indicated in FIGS. 1 and 2, which may be of single or multiple ply.

Figure 8:
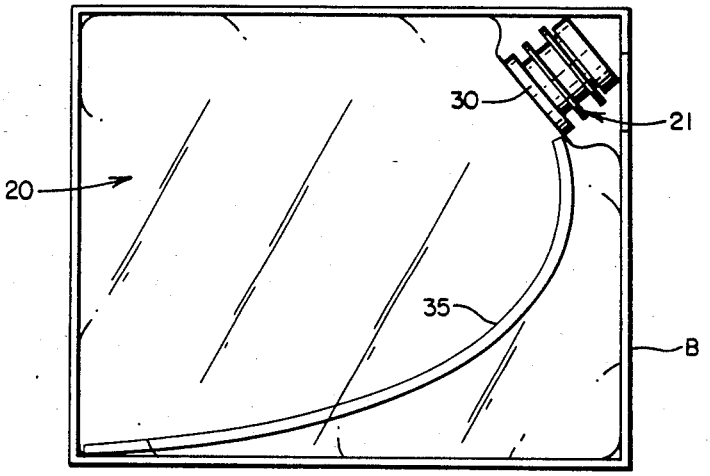
FIG. 8 is a schematic view showing the evacuation channel form unit in a filled bag in a box before use.
Figure 8A:
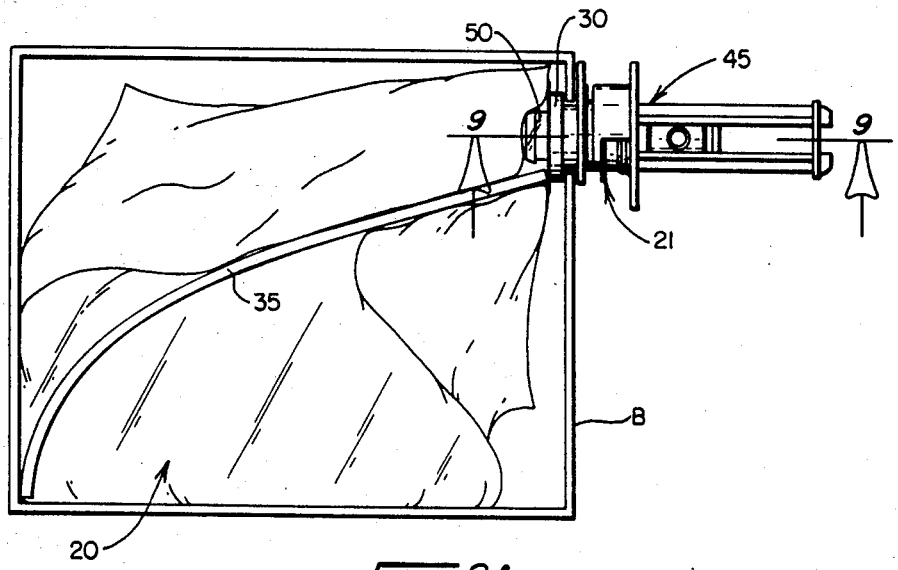
FIG. 8A is a schematic view showing the evacuation channel form attached to the spout of a partially-collapsed bag in a box being evacuated through a valve mounted in the spout.

The spout 21 is molded of semi-rigid plastic and may take various forms but will include a tubular body 26 through which the bag 20 is usually filled and emptied. It is formed to receive a dispensing valve and closure and is provided with means for mounting it on a wall of a box B as indicated in FIG. 8A, the flanges 27 and 28 being praovided for this purpose in this particular spout. The flange 28 is spaced axially-outwardly from the large peripheral attaching flange 29 at its inner extremity which is heat-sealed to the upper wall 23 of the bag. Between the flanges 28 and 29 a cylindrical inwardly-opening ring-receiving socket 30 is formed which has an internal annual locking rib 31 on its inner annular wall surface 32.

One example of insert evacuation channel form unit 25 is shown best in FIGS. 3 to 6 and is an integral structure, preferably molded from plastic. It consists of two main sections, namely, an elongated channel form section 35 and a hingedly connected spout-mounting or attaching ring section 36. The channel form section is of flat multi-channel form with all the channels 37 open at both ends 35*a* and 35 *b* and facing outwardly, being formed by the parallel longitudinnally-extending ribs 38 projecting from a flat wall 39. However, the ribs and flat wall 39 are sufficiently flexible to permit flexing of the form-section 35 in a direction perpendicular to the normal flat plane of the wall 39.

The ring 36 is integrally joined to one end of the form section 35 by an integral hinge tab 40, which spaces end 35*a* from the ring. The ring 36 and form section 35 are molded in substantially the same plane with section 35 extending radially from the ring, but the hinge 40 permits the section 35 to swing to various angles relative to the ring out of the plane of the ring. The ring is so formed that its peripheral outer surface 42 can fit interlockingly within the inner annular surfafce 32 of the spout socket 30 and it has an annular groove 41 on that surface which will receive the annular locking ribe 31 on the socket wall surface but rib and groove may be reversed as in FIG. 9.

Figure 7:
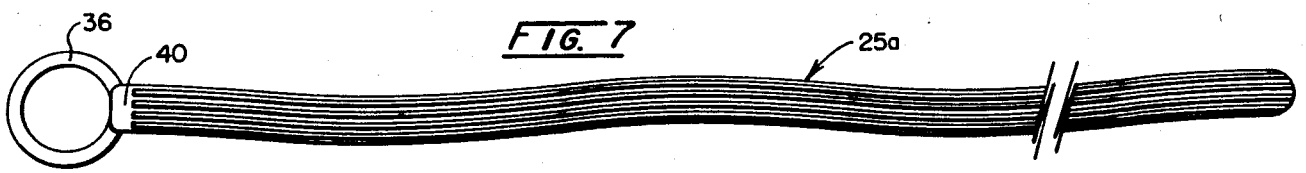
FIG. 7 is a plan view of a modification of the evacuation channel form.

In FIG. 7 there is shown a device 25*a* which is identical with that shown in FIG. 3 except that it has a sinuousoidal curve laterally which will give it more lateral stability.

With the unit 25 inserted in the bag 20 as indicated in FIGS. 1 and 2 and the ring 36 mounted on the spout 21, the mounting or connecting ring 36 will have been snapped into position with the spout socket 30 and will be locked in that position by the spout annular rib 31 and cooperating groove 41. The form section 35 will extend with its lower end 35*b* near the bottom seam 22*a* of the bag. Then if the bag is filled, for example through the spout with the unit 25 in place, it is placed into a box B (FIG. 8) for storing and shipping. When put in use the spout 21 is mounted on the box B, as shown in FIG. 8A, and the form section 35 will extend into the bag 20. The box is shown in FIG. 8A on its side but may be upright, or in any other position. In either case, the form section 35 will flex at hinge 40 relative to the spout-mounting ring 36 and in itself and be long enough to extend to the farthest point in the box. As the contents of the bag is withdrawn, the bag will collapse from its spout end inwardly around the multi-channel form 35 to produce multiple passages to the spout 21 when the spout is positioned above the liquid level.

Figure 9:
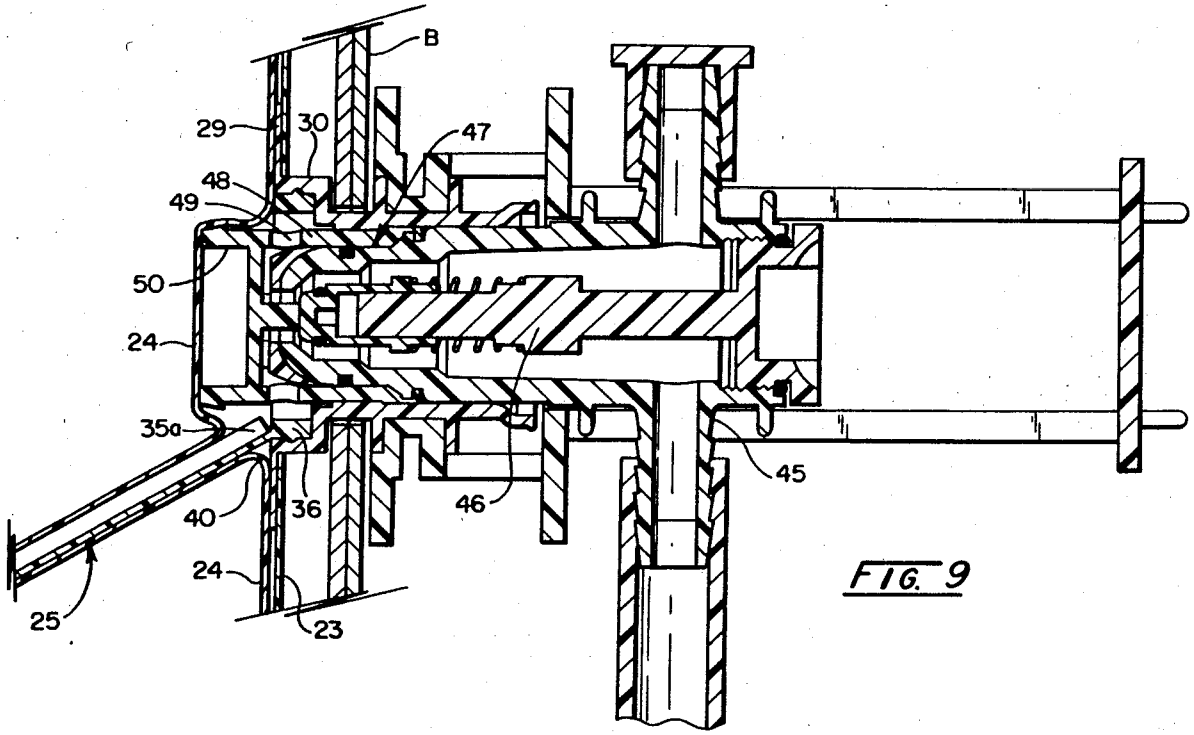
FIG. 9 is an enlarged sectional view taken along line 9—9 of FIG. 8; showing one type of service line connector for evacuating the bag.

The spout may be controlled by various dispensing valves in association with various evacuation systems commonly known and used. In the example shown in FIGS. 8A and 9, the spout 21 has moutned thereon but not limited to an evacuation system of the type disclosed in U.S. Pat. No. 4,421,146 consisting of a seprable service line connector 45, connected to a pump or other evacuator, which has an axially reciprocable probe 46 mounted thereon cooperating with a dispensing valve unit 47 mounted on the spout 21. As disclosed in the patent, axial movement of th probe will move the slide valve member 48 to open or close the radial outlets 49 thereof. In exposing the outlets 49 in the inward position of the slide valve member 48, an inwardly projecting annular skirt 50 on the inner end thereof engages the opposed bag wall 24 as it collapses at the inner end of the spout. This will insure exposure of the outer open end 35*a* of the channel form 35 and maintain clear passage through the ring 36 to the exposed outlets 49. It will be noted that the ring 36 is of sufficient diameter to permit the skirt 50 to pass axially therethrough. Thus passageways will always be maintained through the collapsed part of the bag by the multi-channel form section 35 and by skirt 50 to the ring 36 and the associated radial outlets 49, as indicated in FIG. 9. Other types of closure valves and spouts in common use today may be modified to function in the same manner in combination with the evacuation form unit 25.

Figure 10:
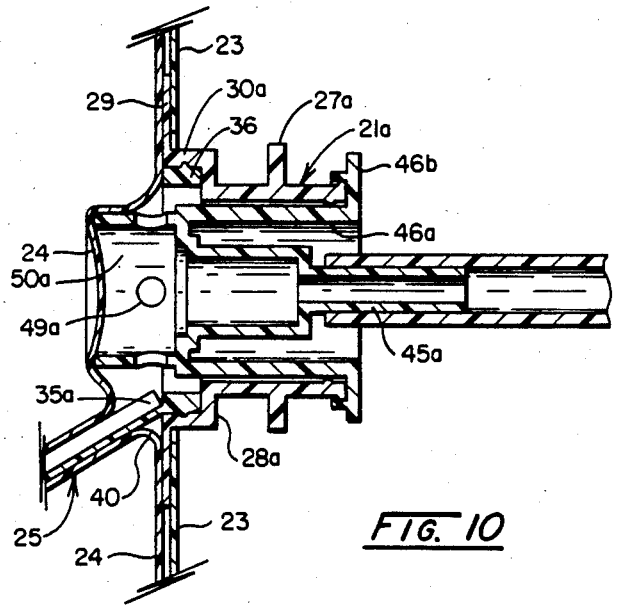
FIG. 10 is a similar view showing a different type of service-line connector on the spout.

FIG. 10 illustrates the evacuation unit 25 of this invention used with a different type of spout and evacuation system. The spout 21*a* is of tubular form and is attached to the bag 20 in a similar manner. It includes the inwardly-opening socket 30*a* for receiving the mounting ring 36 and similar axially-spaced external flanges 27*a* and 28*a* for mounting the spout in the wall of a box. After filling, the spout receives a closure (not shown) which remains sealed to the spout during storage and shipping. When put into use, the closure is removed and the evacuation system is connected and may include a plug-in service-line connector which will be connected to a pump or other suitable evacuator by tubing connected to tube outlet 45*a*. It includes a tubular adaptor 46*a* which is inserted in the spout 21*a* and is frictionally related therein. At the inner side of the adaptor 46*a* is an inwardly-projecting skirt 50*a* having radial outlets 49*a* leading to outlet tube 45*a*. When the adaptor 46*a* is inserted in the spout 21*a* as determined by flange 46*b* and associated retaining means, its inner end will project axially into the ring 36 and its sleeve 50*a* will project even farther. This will hold the bag wall 24 away from the ends of the evacuation channels 37 at form end 35*a* to ensure that the contents can flow from the channels through the outlets 49*a* to tube outlet 45*a*. Thus, all contents of the bag 20 can be evacuated.

Figure 11:
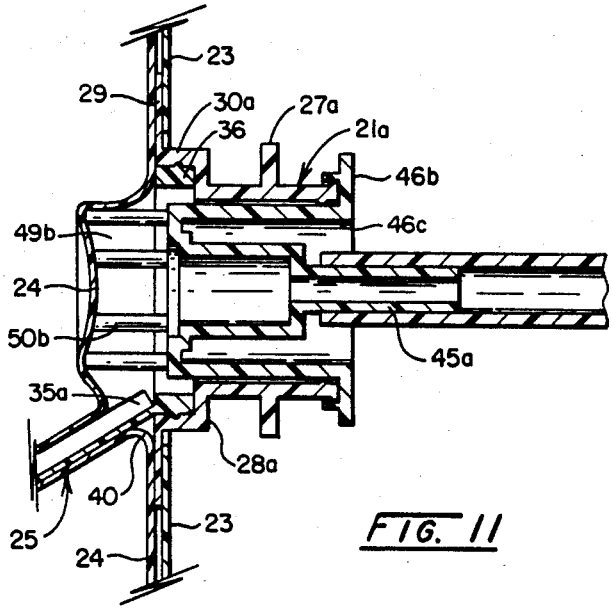
FIG. 11 is another similar view showing still another form of service line connector on the spout.

In FIG. 11, the spout 21*a* is identical with that shown in FIG. 10. The adaptor 46*c* is the same except that it has the inwardly-projecting, angularly-spaced pins 50*b* at its inner end with spaces 49*b* therebetween. The pins 50*b* like the skirt 50*a* will hold the bag wall 24 inwardly away from ring 36 and the ends of the channels at end 35*a*. Thus, the bag contents will flow from the channel passageways through the spaces 49*b* between the pins and to the tube outlet 45*a*.

It will be understood that many other different types of spouts and connecting systems can be used and other examples will be given.

Figure 12:
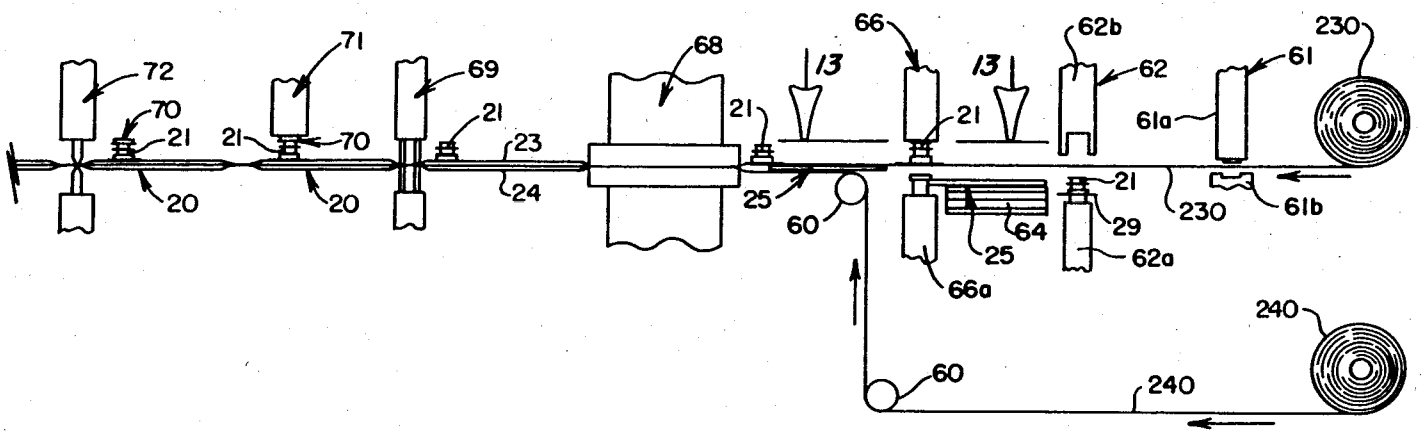
FIG. 12 is a schematic sectional view illustrating the steps of manufacturing flexible bags with the evacuation channels of this invention disposed therein and attached to the spouts thereof.
Figure 13:
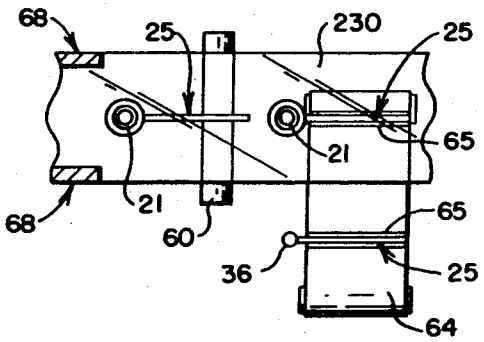
FIG. 13 is a plan view taken on line 13—13 of FIG. 12.

In FIGS. 12 and 13, a preferred method of forming the bag 20 with the evacuation channel form unit 25 inserted therein to the condition shown in FIG. 1 is schematically shown. The bag is formed from plies of suitable plastic or other material as is well known in the art. For sake of simplicity, a roll 230 of single ply web materials is shown for forming the upper wall 23 and a roll 240 of web material is shown for forming the lower wall 24. The web 230 is pulled intermittently horizontally from the roll at an lupper location above the web 240, which is pulled intermittently horizontally from the roll and then vertically around a lower guide roll 60 to an upper guide roll 60 where it is directed horizontally closely beneath the horizontally moving web 230. The web 230, after being pulled under tension from its roll, is subjected first to a punch unit 61 of a common type which is actuated to punch a spout-receiving hole in the web. This unit is provided with a fixed upper punch 61*a* above the web and a vertically movable die 61*b* below the web. The web 230 moves to th next unit 62 which is of a common type and which inserts the spout 21 into the receiving hole formed in the web. This unit includes a cylinder and piston unit 62*a* which supports a spout 21 to move it upwardly into the hole and an upper fixed heating element 62*b* which heat seals the flange 29 of the spout to the web 230 at the edge of the punched opening. Next the evacuation channel form units 25 are moved beneath the web 230 to a position at its longitudinal centerline. This is accomplished with a support conveyor 64 which is disposed transversely of the path of web 230 and the upper run of the belt is directly below that path. This conveyor has regularly-spaced transverse sockets 65 for receiving the units 25 when on the upper run with their rings 36 positioned forwardly of the edge of the conveyor in alignment with the spouts 21 moved into ring-receiving position. When a ring 36 of a unit 25 is in position beneath the spout 21, it is inserted therein by unit 66 which includes a plunger on the end of a lower cylinder and piston unit 66*a* which moves upwardly to engage the ring 36 and push it up into the downwardly-opening socket 30 of the cooperating spout 21 which, at that time, is supported from above by a fixed depending spout support. The two webs 230 and 240, with the unit 25 inserted therebetween, are carried on to a heat sealing unit 68 of a common type which heat seals the sides of the bag being formed in the usual manner and then farther on to a common heat-sealing unti 69 which heat seals the opposite ends of succeeding bags being formed. At this time, the completed bags 20 are connected in a strip and may be supplied in that form with a closure or valve 70 positioned on each spout by a capping unit 71 of a common type if desired. The strip of bags may first pass to a perforating unit 72 of a common type or if the bags are to be supplied individually this may be a separating unit of a common type.

The movement of the webs 230 and 240, of the conveyor 64, and operation of the units 61, 62, 66, 68, 69, 71 and 72 may all be synchronized by the usual means.

It will be apparent from the above that this method provides a simple arrangement for forming the bags 20 with the evacuation channel form units 25 positioned flat therein between the front and rear walls 23 and 24 so that the flat bags 20 can be folded near the perforation or stacked if they are in individual form.

Figures 14, 14A, 15, 16, 16A:
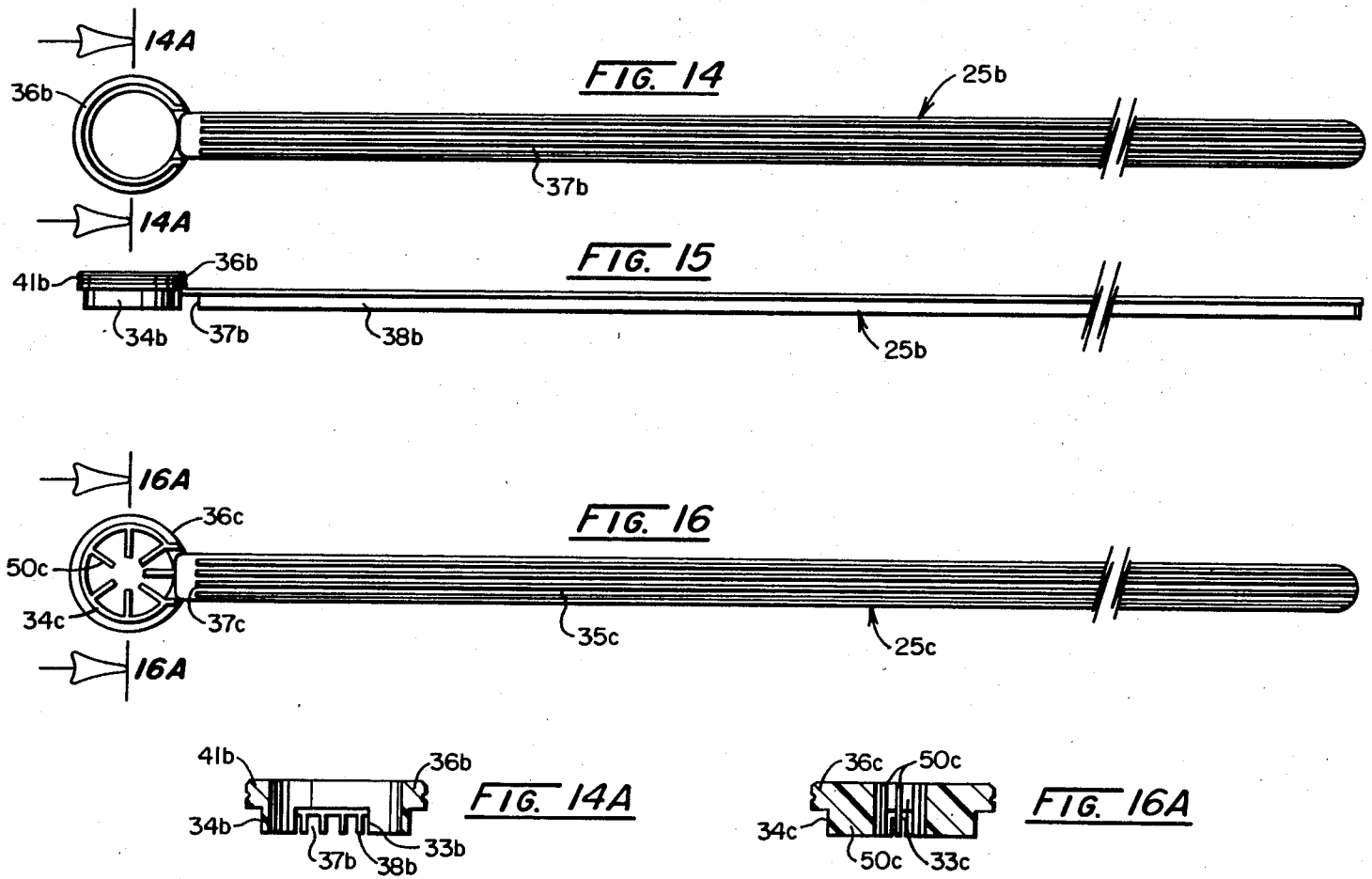
FIG. 14 is a view similar to FIG. 3 showing the evacuation channel form with a modified attaching ring.
FIG. 14A is an enlarged transverse sectional view taken along line 14A—14A of FIG. 14.
FIG. 15 is a side edge view of the unit of FIG. 14.
FIG. 16 is a view similar to FIG. 14 but showing still another form of attaching ring.
FIG. 16A is an enlarged transverse sectional view taken along line 16A—16A of FIG. 16.

In FIG. 14 there is illustrated an evacuation form unit 25*b* which is like that of FIG. 3 except that it has an attaching ring section 36*b* which is of different form to further ensure the exposure of the outer open outlet end of the channel form and maintain clear passage through the ring to the dispensing valve. It will be noted that in this example the ring 36*b* is thicker or deeper, being provided with an almost annular flanges 34*b* which, in the flat condition of form unit 25*b*, projects in the same direction and at least to the same extent as the outward projection of the longitudinally-extending ribs 38*b* (FIGS. 14A and 15) or the flat wall 39*b*. Thus it is of an axial extent at least equal to the depth of ribs 38*b*. It will be noted (FIG. 14A) that this flange 34*b* is eliminated directly radially opposite the inner ends 37*b* of the channels to provide an outlet notch 33*b* and that the flange is of less diameter than the body of the ring. The use of the modified form unit 25*b* is illustrated in FIGS. 17, 19 and 20.

Figure 17:
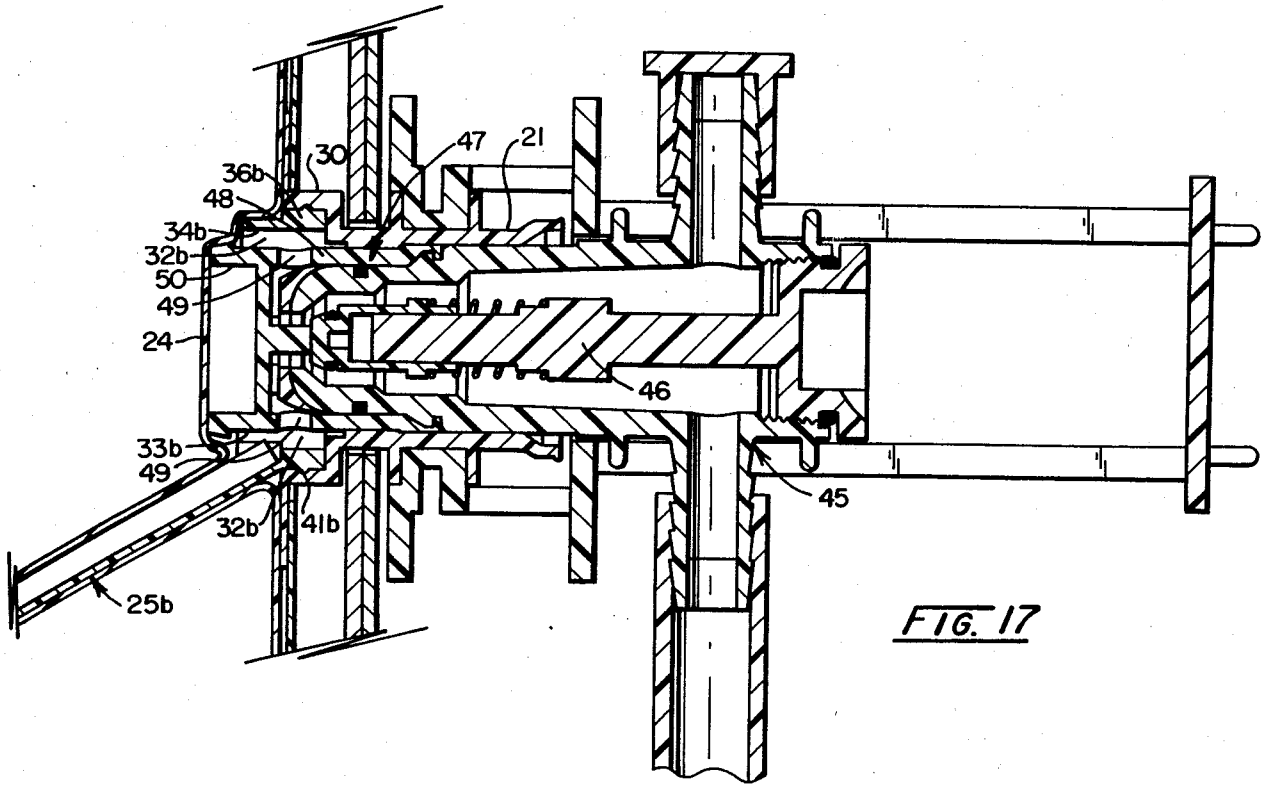
FIG. 17 is a view similar to FIG. 9 but showing the evacuation channel form unit of FIG. 14 used with the spout.

With reference to FIG. 17, the evacuation system shown is identical to that shown in FIG. 9 including the service line connector 45, the reciprocable probe 46 and the dispensing valve unit 47 mounted on the spout 21. As described, the slide valve member 48 will be moved by probe 46 to open or close the radial outlets 49 and the axially inwardly-extending annular skirt 50 is at the inner end of the spout. The ring 36*b* will snap into position within the spout socket 30 and will be locked in that position by the spout annular rib 31 and cooperating ring groove 41*b*. It will be noted, however, that in this example of attaching ring 36*b*, the flange or projection 34*b* thereof is of sufficient depth that it extends axially-inwardly out of the spout socket 30. This projecting flange engages bag wall 24 to flex it inwardly to a greater extent so as to hold the bag wall away from the outlet ends of the channels 37*b*, so as always to permit passage from the evacuation channels and through the notch 33*b* into the interior of ring 35*b* and on to the valve outlets 49. It also provides a longer annular lead-in channel 32*b* around the outlets 49 and thereby prevents the bag wall from being sucked into that channel over the outlets, under high vacuum conditions.

Figure 19:
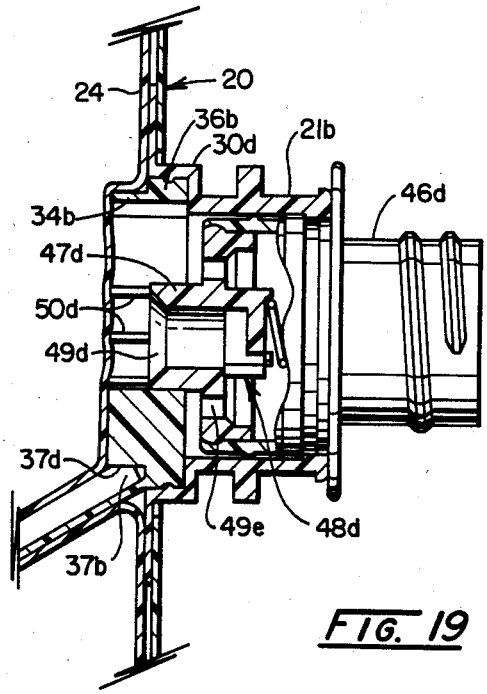
FIG. 19 is a view similar to FIG. 18 but showing a different type of service line connector.

In FIG. 19, the ring 36*b* of the form unit 25*b* is mounted in the spout 21*b* which receives a different type of dispensing valve assembly now in use. The assembly includes an adapter 46*d* that is mounted on the spout and carries a spring-seated valve member 48*d*. The adapter includes an inward axial tubular extension 47*d* which has a central outlet opening 49*d* in its inner end and outlets 49*e* surround this extension. Projecting inwardly from the extension 47*d* are angularly-spaced pins 50*d* which will engage the bag wall 24 as it collapses and prevent it from being sucked into ring 36*b* to cover outlets 49*d* and 49*e*. The ring 36*b* is mounted in spout socket 30*d* exactly as before but it will be noted that the flange 34*b* thereof projects inwardly out of the socket 30*d* beyond the inner end of the spout. This prevents the collapsing bag wall 24 from covering the adjacent ends of the evacuation channels 37*b* of the form unit 25*b*. Since flange 34*b* is offset radially-inwardly from the body of the ring 36*b*, there is an almost annular passage 37*d* extending from the notch 33*b* around the flange to permit a flow through 360° around the ring from the channels 37*b* toward the outlets 49*d* and 49*e*.

Figure 20:
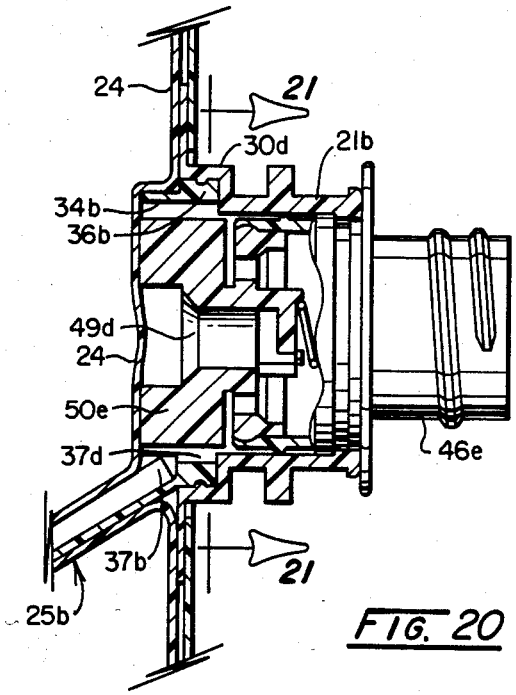
FIG. 20 is a view similar to FIG. 19 but showing the evacuation channel form ulnit of FIG. 14 associated with a different type of service line connector.
Figure 21:
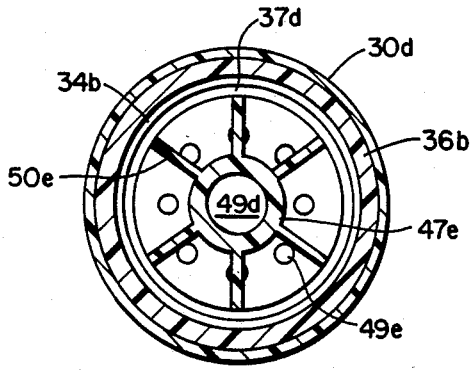
FIG. 21 is a transverse sectional view taken on line 21—21 of FIG. 20.

In FIGS. 20 and 21 the spout 21*b* and dispensing valve assembly are substantially the same as in FIG. 19 but the adapter 46*e* is modified. The ring 36*b* is mounted in and locked in the spout socket 30*d* exactly as before. The inner end of the tubular extension 47*e* is provided with means for preventing the opposed bag wall 24 from being sucked into the ring 36*b* into covering relationship to the central outlet 49 or even the surrounding outlet 49*e* and in aiding in preventing covering of the outlet ends of the channels 37*b* of the form unit 25*b*. This means comprises radially-extending anularly-disposed fins 50*e* formed on the inner end of the extension 47*e* in a spoke-like arrangement. These fins are of substantial axial extent projecting inwardly at least as far as the projection of flange 34*b*. The radial outward extremities of the fins 50*e* terminate short of the flange 34*b* to provide the annular passageway 37*d* which communicates with the adjacent outlet ends of the channels 37*b*. As stated, these fins 50*e* will prevent collapse of the bag wall 24 into the ring 36*b* and will aid in preveting covering of the outlet ends of the channels 37*b* of the form unit 25*b*.

In FIGS. 16 and 16A there is illustrated a modification of the evacuation form unit shown in FIGS. 14 and 14A. This modified form unit 25*c* is the same as the unit 25*b* except that its attaching ring 36*c* is provided with means for preventing the bag wall 24 from collapsing into the ring. This means comprises fins or lugs 50*c* projecting radially-inwardly from the body and flange 34*c* of the ring and arranged in a spoke-like manner but terminating short of the center of the ring to provide a central clear space. It will be noted from FIGS. 16 and 16A that the outlet ends of the channels 37*c* are positioned directly opposite one of the fins 50*c* and that the flange 34*c* at this point is eliminated to provide a flow notch 33*c*. Also, the ring, as in FIG. 14, is of the same or greater thickness than the form section 35*c* of the unit 25*c*. Further, it will be noted that as before the outer diameter of the flange 34*c* is less than the body of the ring. The use of this modified form unit 25*c* is illustrated in FIG. 18.

Figure 18:
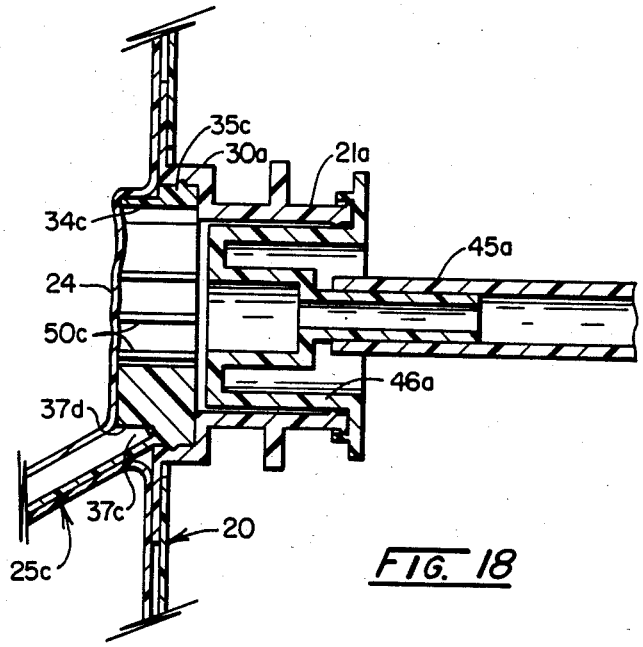
FIG. 18 is a view similar to FIG. 10 but showing the evacuation channel form unit of FIG. 16 used with the spout.

In FIG. 18, the form unit 25*c* is shown applied to a spout and evacuation system of the type shown in FIG. 10 but it can be applied to other systems. This system includes the spout 21*a* which has the inwardly-opening socket 30*a* that receives the attaching and mounting ring 35*c*. This ring is snapped into place in the socket 30*a* and is locked therein as before. The spout receives the adapter 46*a* which is part of the service-line connector. It will be noted that when the ring 35*c* is snapped into locked position within the spout socket 30*a*, the flange 34*c*, being of substantial depth, will project axially-inwardly beyond the inner end of the spout where it, along with the inner edges of the fins 50*c* will engage the opposed bag wall 24 to prevent it from collapsing into the ring and preventing flow to the outlet 45*a*. It will also be noted that the flange 34*c* and fins 50*c* are of sufficient axial extent to prevent the bag wall 24 from being sucked into the ring 35*c* into covering relationship with the outer ends of the channels 37*c*. Thus, flow from these channels toward the outlet 45*a* will not be precluded. Because the flange 34*c* is offset radially-inwardly from the body of the ring 36*c*, there is an almost annular passage 37*d* extending from the notch 33*c* around the flange to permit a flow through 360° around the ring from the channels 37*c* toward the outlet 45*a*.

The bags supplied as separate bags or as a strip of bags with the inserted evacuation channel forms therein can be filled by the usual automatic or semi-automatic filling machine. When filled and disposed in a box, the evacuation channel form will extend to the point in the box farthest from the spout whether the box is upright or on its side. As the bag is evacuated and collapses, it will collapse around the multi-channel evacuation form which will produce passages to the spout. The mounting ring for mounting the channel form on the spout will not interfere with movement of respective dispensing valve or connector parts inwardly through the spout into the bag. Means is provided to prevent the wall of the bag opposite the inner end of the spout from being sucked into the spout to close the outlets of the associated valve or to close the outlet end of the evacuation channel. This means may be on the spout in the form on the inwardly-extended flange on the attaching ring of may be on the valve assembly in the form of extensions, or both, and both of which extend inwardly beyond the inner end of the spout.

Having thus described the invention, what is claimed is:

1. A substantially flat collapsed bag with a form insert unit disposed therein, said bag comprising opposed superimposed substantially flat walls having a spout extending outwardly from one of the walls adjacent an end of the bag and having an open inner end, said form insert unit comprising an elongated form connected to the spout and being of channel shape to direct the bag contents thereto when the filled bag is evacuated and collapses therearound, said form unit also including a connecting ring which connects with the spout and which has the elongated channel form flexibly attached thereto, said connecting ring fitting into the inner end of the spout and having a portion projecting axially inwardly therefrom, said axially projecting portion of the connecting ring and the elongated channel form being of substantially the same thickness.

2. A bag according to claim 1 in which the elongated channel form has a plurality of channels disposed side-by-side and opening outwardly, said elongated channel form including a flat flexible wall with parallel ribs extending outwardly from one face thereof to provide a plurality of channels, said projecting portion of the ring being a flange which extends axially in the same direction as said outwardly-extending ribs and at least to the same extent.

3. A bag according to claim 2 in which the ring has an annular body with said flange thereon and axially-extending, said flange being of less diameter than said body to provide a recess therearound.

4. A bag according to claim 3 in which the channels terminate short of said flange on said ring, said flange having a flow opening formed therein opposite said channels.

5. A bag according to claim 2 in which one end of the eflat wall is connected to the ring by a flexible hinge.

6. A bag according to claim 5 in which the flat wall extends radially from the ring.

7. A bag according to claim 6 in which the ribs on the flat wall terminate just short of the ring.

8. A bag according to claim 7 in which the ring has a body which fits into a socket at the inner end of the spout and has said flange extending axially inwardly therefrom out of the spout socket beyond the inner end of the spout.

9. A bag according to claim 8 including cooperating retaining rib and groove means between the ring and spout socket to hold the ring in the socket.

10. A bag according to claim 8 in which the flange is a less diameter than the ring body.

11. A substantially flat collapsed bag with a form insert unit disposed therein, said bag comprising opposed superimposed substantially flat walls having a spout extending outwardly from one of the walls adjacent an end of the bag, said form insert unit comprising an elongated form connected to the spout and being of channel shape to direct the bag contents thereto when the bag is evacuated and collapses therearound, said form unit also including a connecting ring which connects with the spout and to which the elongated channel form is flexibly attached, said ring carrying angularly-spaced radially-inwardly extending ribs.

12. A bag according to claim 11 in which the ring comprises a body and an axially-inwardly-extending flange, said body and flange carrying said radially-inwardly extending ribs.

13. A bag according to claim 12 in which the flange is of less diameter than the ring body.

14. A bag according to claim 12 in which the ring body fits into a socket at the inner end of the spout and the flange extends inwardly beyond the spout.

15. A bag according to claim 12 in which the ring flange has a flow opening opposite the inner ends of said ribs.

16. A collapsible container having a spout extending outwardly therefrom, a form unit connected to an inner portion of the spout and extending into the container and about which the container will collapse as its contents are removed through the spout, said form unit comprising a connecting ring connecting with the spout, and an elongated form of channel shape flexibly connected to the ring, said spout having a tubular passage and a socket at the inner end thereof into which the ring fits to be concentric therewith in combination with a dispensing means mounted on the spout and having an outlet, and means for preventing a wall of the container opposite the spout inner end from being sucked into closing position to said outlet when the container is being evacuated, said last-named means including wall-engaging means at the inner end of the spout extending inwardly beyond the spout during the evacuation of the container in the form of an inward projection carried by the spout said inward projection carried by the spout being a flange on said ring which projects axially-inwardly of said inner end of the spout, said elongated form comprising a flat elongated wall with a plurality of parallel ribs on its face to form a plurality of channels, said flat wall being connected by a flexible hinge to the ring at one of its ends, said ribs terminating short of said hinge.

17. The combination of claim 16 in which the flange has a flow-opening opposite said ribs.

18. The combination of claim 17 in which the ring carries radially-inwardly extending angularly spaced wall-engaging ribs.

19. The combination of claim 16 in which the dispensing means includes a member disposed within said spout with its outlet in dispensing position, said member carrying axially-inwardly extending projections which engage siad container wall.

20. A form unit for insertion into a collapsible container having a spout so that as the filled container is emptied the walls of the container can collapse around it, said form unit comprising a ring for mounting the unit on the spout end and an elongated channel form flexibly connected to the ring and comprising a flat elongated wall connected radially to the ring by a flexible hinge, a plurality of parallel ribs disposed along one face of the wall to form multiple channels, said ribs terminating short of the hinge, said ring having a body with a flange projecting axially therefrom, said flange having a flow-opening adjacent the adjacent ends of the ribs.

21. A unit according to claim 20 in which the flange is of less external diameter than the ring body to provide a recess therearound.

22. A unit according to claim 20 in which the flange projects in the same direction and at least to the same extent as said ribs.

23. A unit according to claim 22 in which the ring carries radially-extending angularly-spaced ribs.

24. An evacuation form unit for emplacement within a flexible collapsible container for liquids having a spout so that as the filled container is emptied the walls of the container collapse about the unit, said unit comprising an attaching ring for mounting the unit on the spout and an elongated member flexibly connected to the ring, said member having at least one continuous longitudinal liquid passage capable of communicating along its length with a body of liquid in the container and of maintaining the integrity of said passage as the container walls collapse about said member by the evacuation of the container, said ring being of a thickness at least equal to that of the elongated member.

25. An evacuation form unit for emplacement within a flexible collapsible container for liquids having a spout so that as the filled container is emptied the walls of the container collapse about the unit, said unit comprising an attaching ring for mounting the unit on the spout and an elongated member flexibly connected to the ring, said member having at least one continuous longitudinal liquid passage capable of communicating along its length with a body of liquid in the container and of maintaining the integrity of said passage as the container walls collapse about said member by the evacuation of the container, said ring carrying radially-inwardly-extending angularly spaced ribs.

26. A bag according to claim 6 in which the elongated channel form has a sinousoidal curve laterally.

27. A substantially flat bag for liquids comprising opposed substantially flat walls having a spout extending outwardly from one of the walls, an evacuation unit extending from said spout into the remote reaches of the interior of the bag in the form of an elongated form member having at least one continuous longitudinal passage with an inner end connected to the spout and being capable of communicating along its length with a body of liquid supplied in the bag and being capable of maintaining the integrity of said passage from the liquid body to the spout as the bag walls collapse about said member by the evacuation of the liquid; means for flexibly attaching said elongated member at said inner end of said member in liquid communication with said spout so that said elongated member extends transversely from the spout and lies flat between the opposed walls before the bag is filled and to enable it to swing flexibly therefrom into the body of liquid when the bag is filled, said attaching means comprising a ring which fits into said spout at its inner end and extends axially outwardly therefrom, said ring having radially-inwardly-extending angularly-spaced ribs to prevent sucking of the opposed bag wall into the spout during evacuation of the bag.

* * * * *